United States Patent [19]

Metz

[11] Patent Number: 4,894,955

[45] Date of Patent: Jan. 23, 1990

[54] FRAME PROFILE AND PROFILE CLAMP THEREFOR

[75] Inventor: Laurens Metz, Hilversum, Netherlands

[73] Assignee: Bomar Kozijnen B.V., Netherlands

[21] Appl. No.: 209,368

[22] Filed: Jun. 21, 1988

[30] Foreign Application Priority Data

Jun. 22, 1987 [NL] Netherlands ..... 8701445

[51] Int. Cl.[4] ..... E06B 1/04

[52] U.S. Cl. ..... 49/504; 52/213

[58] Field of Search ..... 49/504; 52/213, 211

[56] References Cited

U.S. PATENT DOCUMENTS

| | | | |
|---|---|---|---|
| 1,929,633 | 10/1933 | Gifford . | |
| 3,924,373 | 12/1975 | Lizdas et al. | 52/213 |
| 4,223,494 | 9/1980 | Wendt | 49/504 X |
| 4,251,962 | 2/1981 | Langenhorst | 49/504 X |
| 4,637,183 | 1/1987 | Metz | 49/504 X |

FOREIGN PATENT DOCUMENTS

| | | |
|---|---|---|
| 511102 | 7/1980 | Australia . |
| 0140436 | 9/1987 | European Pat. Off. . |
| 8500395 | 2/1985 | Netherlands . |

*Primary Examiner*—Philip C. Kannan

*Attorney, Agent, or Firm*—Watson, Cole, Grindle & Watson

[57] ABSTRACT

A framing member of general U-shape includes spaced legs having inner generally parallel flanges each of which terminates in an inner penetrating edge. Each of the inner flanges and the joined leg portion defines an S-shape. Internal clamping members urge the inner flanges toward one another, causing the inner penetrating edges to penetrate into a protruding member so that the framing member encloses the protruding member with the penetrating edges hidden from view.

7 Claims, 1 Drawing Sheet

FIG.1
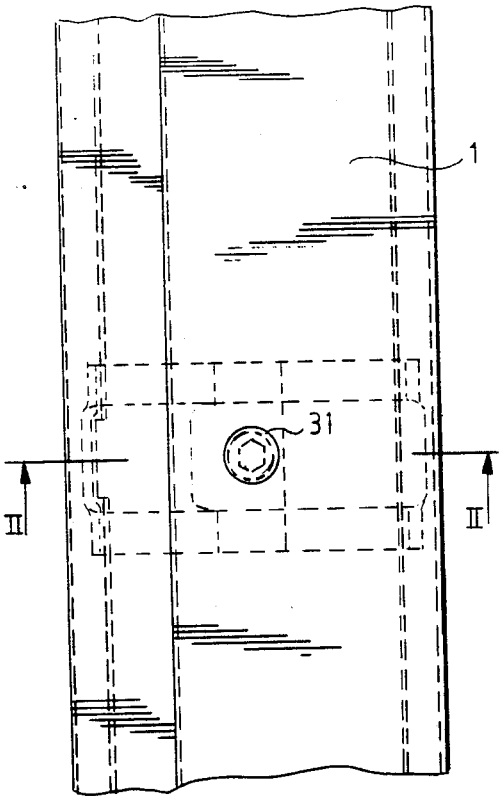
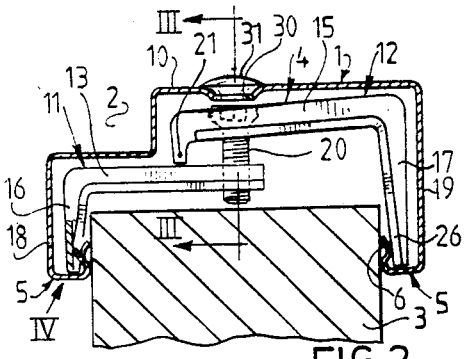
FIG.2
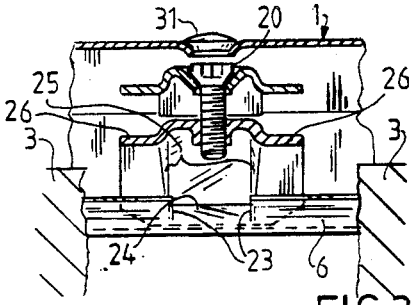
FIG.3
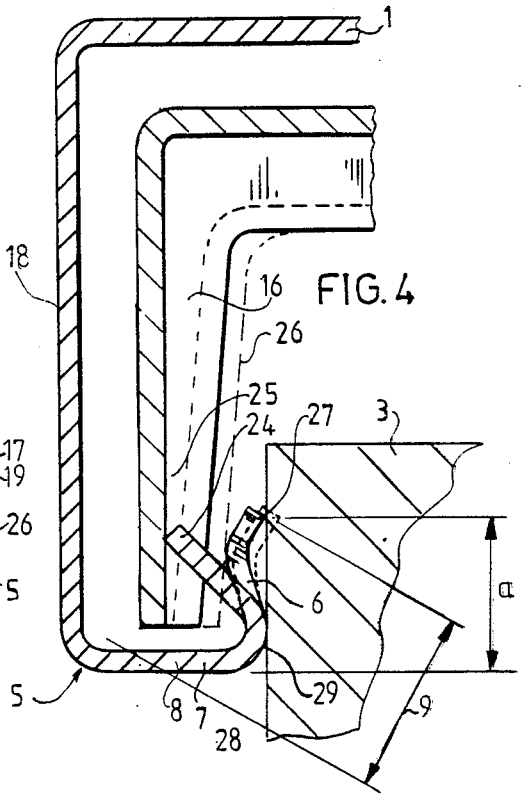
FIG.4
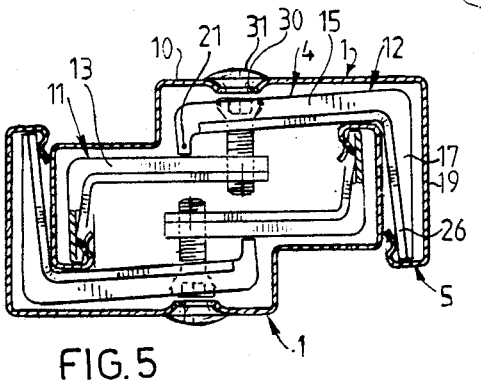
FIG.5

FRAME PROFILE AND PROFILE CLAMP THEREFOR

The invention relates to a frame profile that is substantially U-shaped and has at least one substantially U-shaped edge.

The invention has for its object to provide a frame profile that can be attached firmly and without causing damage to a finished surface of a wall edge. To this end the frame profile according to the invention has the feature that the inner edge flange of the U-shaped edge forms, together with a connecting piece of the edge body of this U-shaped edge, an S-shaped profile piece, and that a clamping member grips onto the inner flange such that an edge end located at an interval from the edge body grips for anchoring on a wall edge.

Displacement of the frame profile in the direction away from the wall edge is counteracted to a great extent as a result of the anchoring action of the edge end.

It is remarked that a frame profile is known, the edges of which are not U-shaped. The edges then come up against the wall face at a right angle thereto. When these edges are clamped towards the wall face, a firm clamping on the wall face is indeed realized, but the edge thereby penetrates into the outer layer, for example a plaster layer, of the wall, which can result in the plaster work coming loose locally. Visible damage occurs particularly when, following initial clamping into position, the frame profile is moved slightly in order then to be clamped into a definitive position.

In preference the inner edge flange has a local deformation at the position of at least one clamp. The position of the clamp in lengthwise direction of the frame profile is then easy to determine and fix.

The invention also relates to and provides a profile clamp as designated in claim 3. This profile clamp may be seen as an improvement of the profile clamp described in the Netherlands patent application No. 8500395.

The invention will be elucidated in the description following hereinafter with reference to a drawing. In the drawing in schematic form:

FIG. 1 shows a side view of a frame profile according to the invention having incorporated therein a profile clamp according to the invention;

FIG. 2 is a section along line II—II from FIG. 1;

FIG. 3 is a section along line III—III from FIG. 2;

FIG. 4 shows on a large scale the detail IV from FIG. 2; and

FIG. 5 shows two frame profiles in a transporting situation.

The frame profile 1 according to the invention has a substantially U-shaped profile with a recess 2 for receiving a door or window. This frame profile 1 is fixed in position on a wall edge 3 by means of a profile clamp 4. Frame profile 1 has two substantially U-shaped edges 5. The inner flange 6 and a connecting piece 7 of an edge body 8 of a U-shaped edge 5 together form a substantially S-shaped profile piece 9. Profile clamp 4 comprises a first angular clamping member 11 of which a first leg 13 extends along the body 10 of frame profile 1 and a second leg 16 extends along the narrow frame flange 18 of frame profile 1 located by the recess 2. Profile clamp 4 further comprises a second angular clamping member 12 of which a first leg 15 extends along the body 10 and a second leg 17 extends along a wide frame flange 19 of frame profile 1. Profile clamp 4 further comprises support means 21 integral with leg 15 which supports both first legs 13 and 15 for mutual pivoting.

The first clamping member 11 has a second leg 16 that is slightly shorter than the narrow frame flange 18 present by the recess 2 and which is considerably shorter than the second leg 17 of the second clamping member 12. The second leg 17 is slightly shorter than the recess-free, broad frame flange 19. The first clamping member 11 is substantially L-shaped, while the second clamping member 12 is substantially U-shaped. Support means 21 forms together with the clamping screw 20 the fastening means with which the clamping members 11 and 12 are attached for pivoting to each other and with which the profile clamp 4 is tensioned for fixing the frame profile 1 firmly in position on wall edge 3.

As FIG. 3 shows, the inner flange 6 has two incisions 23 at the location of the profile clamp 4, while the edge piece 24 lying between is curved towards the frame flanges 18 and 19. This edge piece 24 grips in a cavity 25 of a channel-like profiled first member 11 and a similar edge piece 24 formed on the other edge 5 of the profile grips in a cavity formed in second clamping member 12. Side edges 26 of the clamping members 11, 12 grip adjacent to edge pieces 24 onto the inner flange 6 and during tensioning of profile clamp 4 press the edge end 27 slightly into the material of the wall edge 3, which results in the inner flange 6 gripping for anchoring on wall edge 3. Close to the visible portion 28 of wall edge 3 the frame profile 1 is rounded off with a bend 29 so that the lie of the profile edge 5 at that location does not result in damage. The edge end 27, which can cause some surface damage to wall edge 3, lies at an interval a from the edge body 8. The clamping screw 20 in the form of a recessed head screw is accessible using a sizeable socket head screwdriver via an opening 30 arranged in the body 10 and closable with a cap 31. The clamping members 11 and 12 which are profiled over virtually their whole length are manufactured from reinforced metal and are practically form-rigid.

Because of the large pivot angle over which the clamping members 11 and 12 can move relative to each other, the profile flanges 18 and 19 can move over a considerable range relative to each other, which results in the frame profile according to the invention being suitable for bridging wall edges with a large thickness tolerance. Through the use of a large socket head screwdriver which can be inserted into a substantial recessed hole of the recessed head screw 20, it is easy to apply a large fixing force by hand, for example a clamping force of more than 100 kg. The point at which the ideal clamping force is reached is not difficult to judge.

FIG. 5 shows how two frame profiles 1 together with their profile clamps 5 may be laid into each other and transported using a minimum transporting space.

I claim:

1. A frame profile of substantially U-shaped configuration and having at least one substantially U-shaped edge including an inner edge flange, said flange together with the edge portion connected thereto being of substantially S-shape and having an end edge spaced from said edge portion, clamping means engaging said flange for urging said end edge into anchoring engagement with an associated wall, said flange having a local deformation at the position of said clamping means.

2. A framing member adapted to fit over, partially enclose and preferentially penetrate into a protruding member of finite thickness at regions thereof which are hidden from view by the partially enclosing framing member, which comprises a generally U-shaped, flexible frame presenting spaced legs interconnected by a bight portion which define the general U shape of the frame, each of the legs presenting an inner flange terminating in an inner penetrating edge with the inner flanges of the legs disposed in spaced, generally parallel relation to receive the protruding member therebetween, the inner flanges and those portions of the legs to which they are immediately joined being of S-shape to localize contact of the inner penetrating edges with the protruding member, internal clamping means disposed within the frame for urging the inner flanges toward each other preferentially to penetrate the inner penetrating edges thereof into the protruding member, and inwardly struck tabs on the inner flanges which are engaged by the clamping means to assist in localizing contact of the inner penetrating edges with the protruding member.

3. In combination, a frame profile of substantially U-shaped configuration, said frame profile including a body portion defining a recess at one end thereof, said body portion being connected with a narrow flange portion at one side adjacent said recess and a wide flange portion at the opposite side thereof, a first clamping member of substantially L-shaped configuration, a second clamping member of generally U-shaped configuration, said first clamping member having a first leg extending along said body portion and a second leg extending along said narrow flange portion, said second clamping member having a first leg extending along said body portion and a second leg extending along said wide flange portion, a clamping screw interengaging the first legs of said clamping members, the second leg of said first clamping member being slightly shorter than the adjacent part of said narrow flange and being substantially shorter than the second leg of said second clamping member, the second leg of said second clamping member being slightly shorter than the adjacent part of said wide flange, said second clamping member including a third leg generally parallel with the second leg of said second clamping member, said third leg having an end portion engaging said first leg of said first clamping member for supporting the first and second clamping members for pivotal movement with respect to one another.

4. A frame profile of substantially U-shaped configuration and having at least one substantially U-shaped edge including an inner edge flange spaced from the outer side of said edge, said flange together with the edge portion connected thereto being of substantially S-shape and having an end edge spaced from said edge portion, said S shape including first and second contiguous reversely curved flange portions, said first curved portion defining a generally concave surface facing toward the outer side of said edge, said second curved portion defining a generally concave surface facing away from the outer side of said edge and terminating in said end edge, and clamping means engaging said flange for urging said end edge into anchoring engagement with an associated wall.

5. A framing member adapted to fit over, partially enclose and preferentially penetrate into a protruding member of finite thickness at regions thereof which are hidden from view by the partially enclosing framing member, which comprises a generally U-shaped, flexible frame presenting spaced legs interconnected by a bight portion which define the general U shape of the frame, each of the legs presenting an inner flange having an inner penetrating edge with the inner flanges of the legs disposed in spaced, generally parallel relation to receive the protruding member therebetween, the inner flanges and those portions of the legs to which they are immediately joined being of S-shape to localize contact of the inner penetrating edges with the protruding member, said S shape including first and second contiguous reversely curved portions, said first curved portion defining a generally concave surface facing toward the associated leg, said second curved portion defining a generally concave surface facing away from the associated leg and terminating in said end edge, and internal clamping means disposed within the frame for urging the inner flanges toward each other preferentially to penetrate the inner penetrating edges thereof into the protruding member.

6. A framing device for framing a wall edge including spaced generally parallel opposite wall faces, comprising a generally U-shaped flexible frame including spaced legs and a bight portion, each of said legs including terminal end portions of generally U-shaped configuration defining an outer flange and an opposite inner flange, each of said inner flanges including a curved portion for engaging an associated wall face without damage thereto, a first inner flange portion extending from said curved portion toward said bight portion and outwardly toward the opposite outer flange so as to be spaced from an associated wall face, a second inner flange portion extending from said first inner flange portion toward said bight portion and inwardly away from the opposite outer flange and terminating in a sharp edge for engaging an associated wall face, and clamping means disposed within said frame for engaging said inner flanges and urging said inner flanges toward one another so that the sharp edge of each of said inner flanges penetrates an associated wall face to anchor the framing device in place with the rounded portion pressed against the associated wall face to hide said edge from view.

7. In combination, a wall edge including spaced generally parallel opposite wall faces joined by an end face, a generally U-shaped flexible frame including spaced legs and a bight portion, each of said legs including an inner flange terminating in a sharp edge, the inner flanges and those portions of the legs to which they are immediately joined being of gnerally S-shaped configuration to define a rounded portion spaced from said edge, and clamping means disposed within the frame for urging the inner flanges toward one another with each of said rounded portions and the adjacent edges engaging the associated wall face with the portion of the inner flange between each rounded portion and the adjacent edge spaced from the associated wall face.

* * * * *